US007540064B2

(12) United States Patent
Cho et al.

(10) Patent No.: US 7,540,064 B2
(45) Date of Patent: Jun. 2, 2009

(54) SUCTION NOZZLE AND HEAD OF VACUUM CLEANER HAVING THE SAME

(75) Inventors: Hyoung-Joo Cho, Gyeongsangnam-Do (KR); Kyeong-Seon Jeong, Busan (KR); Jung-Wan Ryu, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 749 days.

(21) Appl. No.: 10/527,316

(22) PCT Filed: Mar. 16, 2004

(86) PCT No.: PCT/KR2004/000562

§ 371 (c)(1),
(2), (4) Date: Mar. 10, 2005

(87) PCT Pub. No.: WO2005/087073

PCT Pub. Date: Sep. 22, 2005

(65) Prior Publication Data

US 2006/0282979 A1 Dec. 21, 2006

(51) Int. Cl.
*A47L 9/06* (2006.01)

(52) U.S. Cl. ..... 15/401; 15/402; 15/415.1; 15/420

(58) Field of Classification Search ..... 15/401, 15/402, 415.1–422.1; *A47L 9/06*
See application file for complete search history.

(56) References Cited

FOREIGN PATENT DOCUMENTS

| | | |
|---|---|---|
| EP | 0307881 | 3/1989 |
| EP | 0382598 | 8/1990 |
| EP | 1238620 | 9/2002 |
| GB | 315177 A | 7/1929 |
| WO | WO02/26097 | 4/2002 |

*Primary Examiner*—David A Redding
(74) *Attorney, Agent, or Firm*—Ked & Associates LLP

(57) ABSTRACT

A suction nozzle and a head of a cleaner having the same includes a suction hole to which a suction force is applied; an air channel formed as a closed region having predetermined area and depth and having the suction hole therein; and scraper longer than an end of an edge of the air channel, positioned in the air channel, and for scraping carpet fibers in cleaning a carpet. Especially when cleaning a carpet, the suction nozzle and the head of a cleaner having the same sufficiently push back carpet fibers to their root portions by the scraper to suck dust and alien substances, so that the carpet can be cleaned more cleanly, a suction path through which external air is introduced is formed in a direction that a cleaning proceeds, and thus dust or alien substances can be effectively removed.

18 Claims, 5 Drawing Sheets

[Fig. 1]
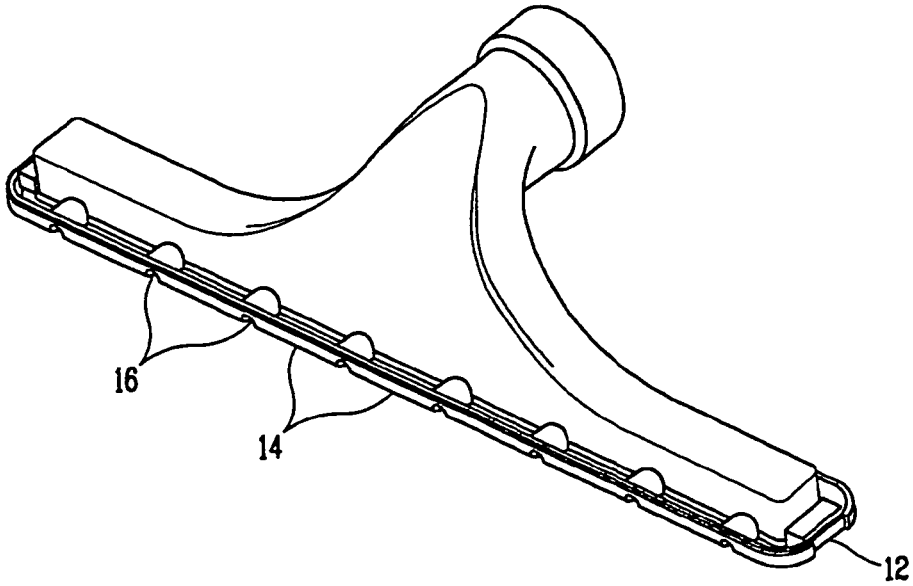
[Fig. 2]
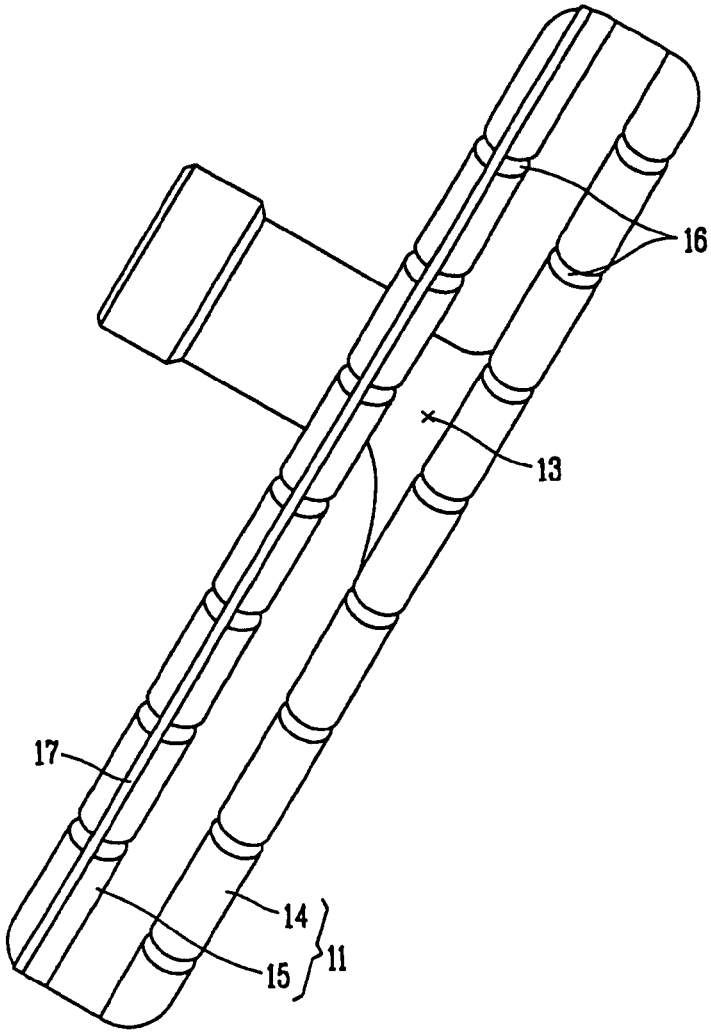

[Fig. 3]
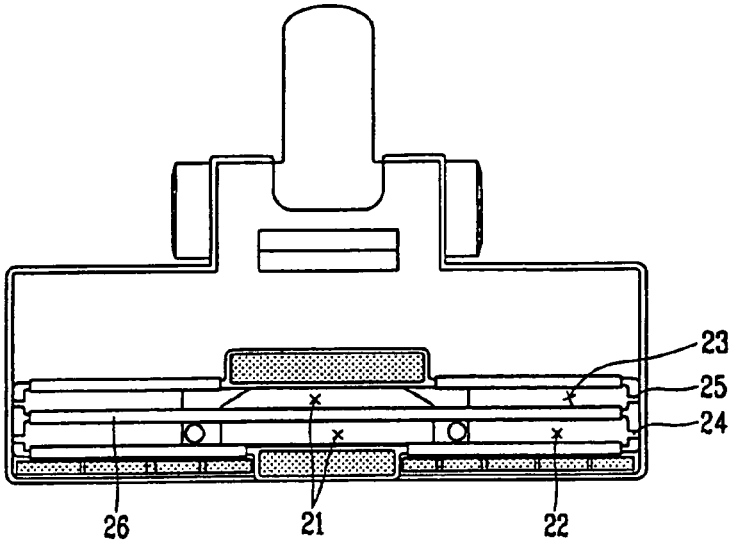
[Fig. 4]
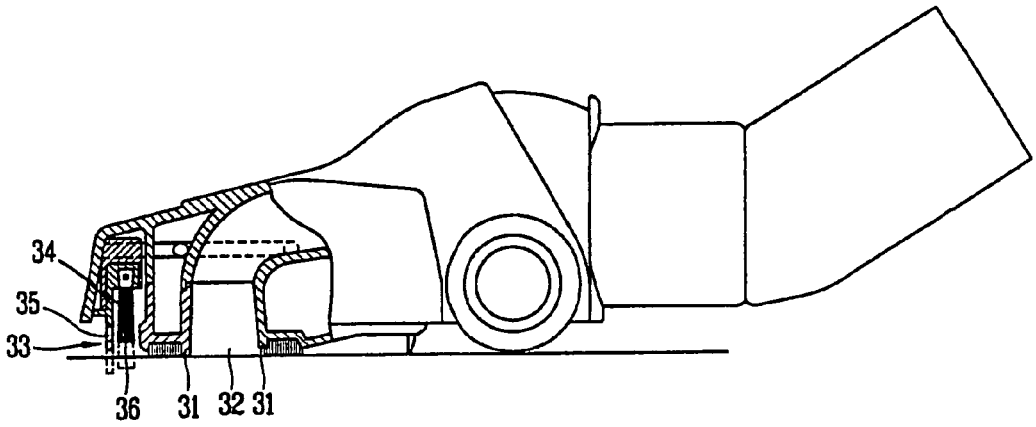
[Fig. 5]
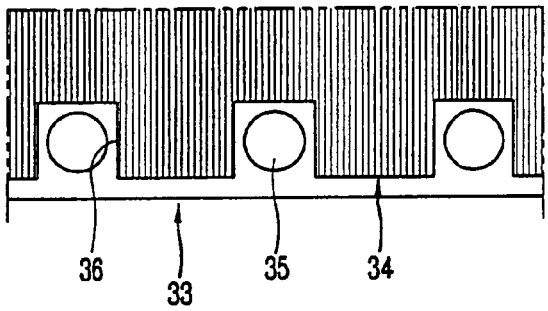

[Fig. 6]
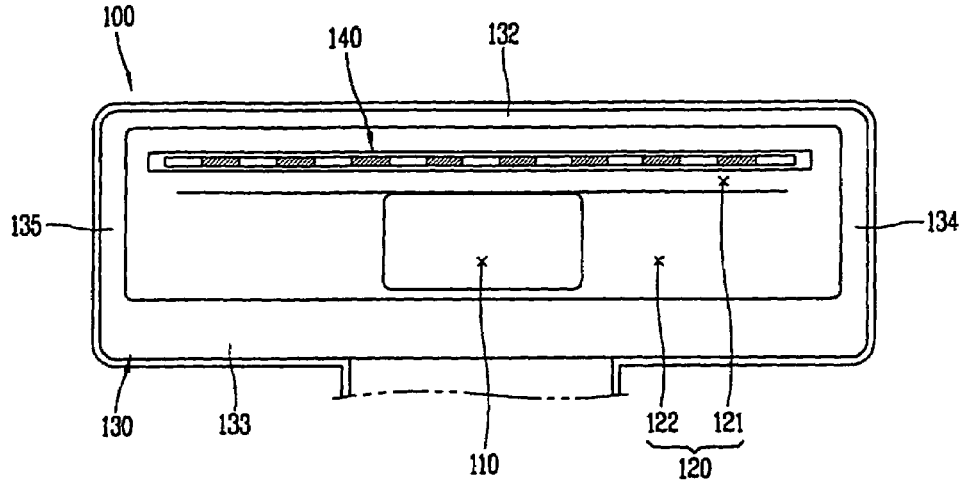
[Fig. 7]
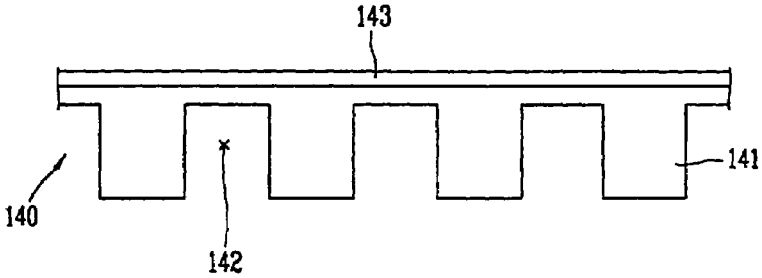
[Fig. 8]
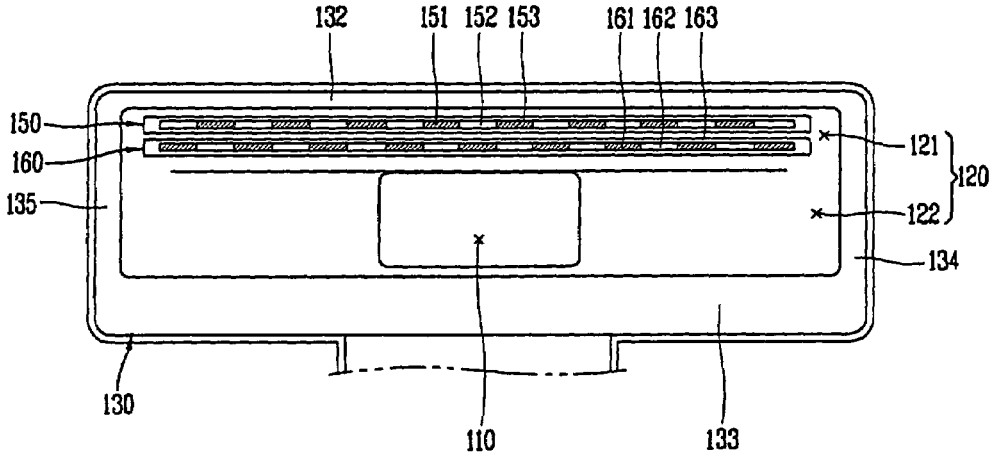

[Fig. 9]
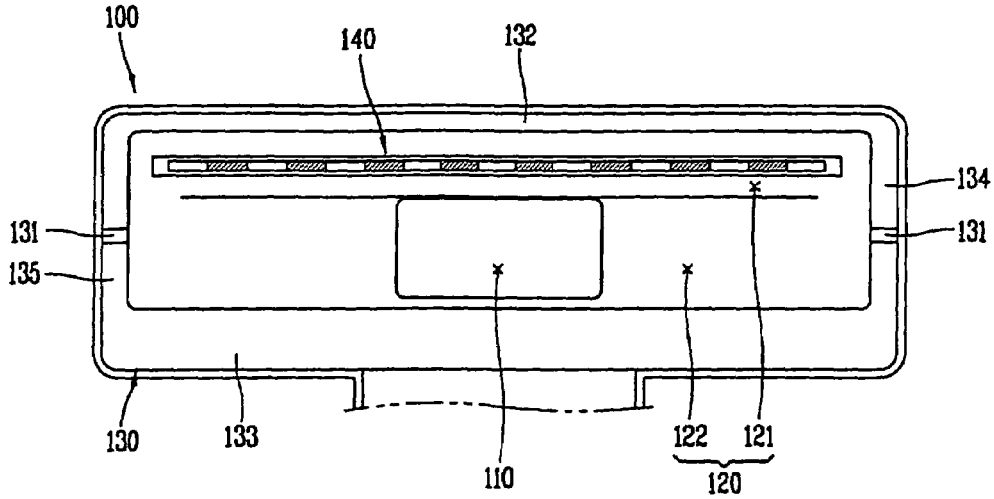
[Fig. 10]
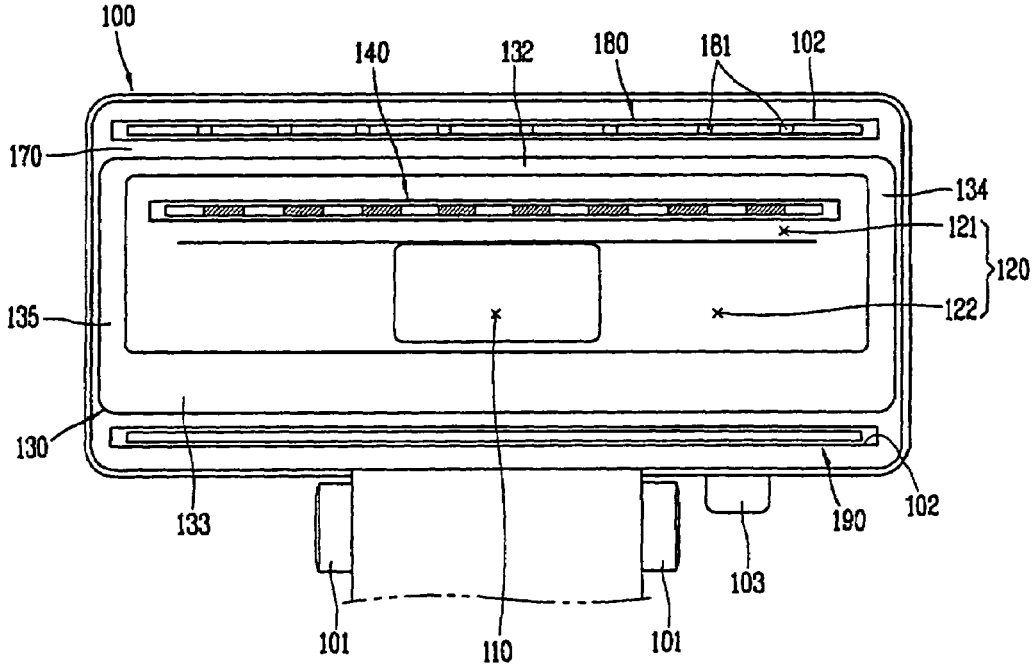
[Fig. 11]
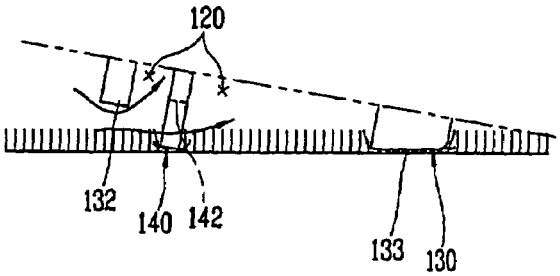

[Fig. 12]
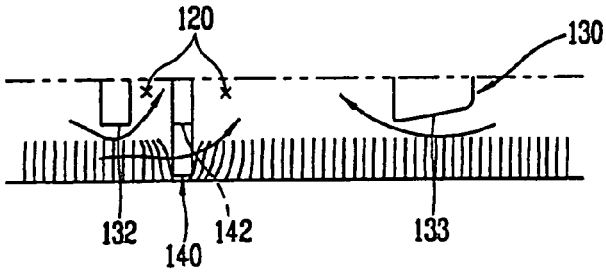
[Fig. 13]
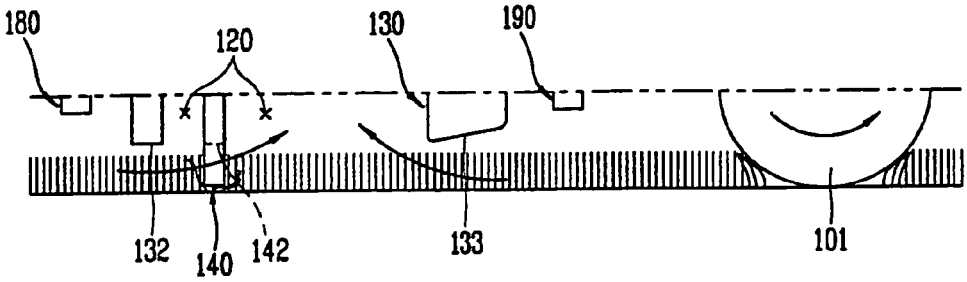
[Fig. 14]
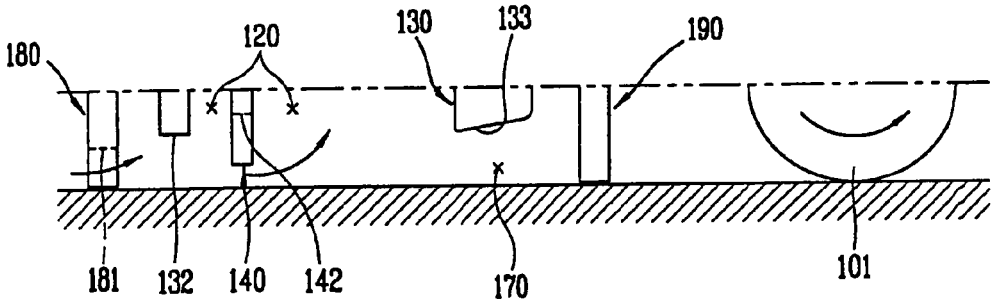

SUCTION NOZZLE AND HEAD OF VACUUM CLEANER HAVING THE SAME

TECHNICAL FIELD

The present invention relates to a cleaner, and particularly, to a suction nozzle and a cleaner head having the same capable of effectively sucking alien substances such as dust from a non-carpeted floor and also effectively sucking alien substances such as dust or crumbs from roots of carpet fibers in cleaning a carpet.

BACKGROUND ART

A vacuum cleaner is mainly used for a convenient cleaning at home or office, and there are various kinds of vacuum cleaner.

In general, a vacuum cleaner includes a cleaner main body generating a suction force and filtering alien substances such as dust, crumbs, sand or the like; a cleaner head through which alien substances are sucked together with air by a suction force generated at the cleaner main body; and a connection hose connecting the cleaner main body and the cleaner head.

In such a cleaner, when a suction force is generated in the cleaner main body, alien substances on a floor are sucked together with air through the cleaner head by the suction force and are introduced to the cleaner main body. The alien substances introduced into the cleaner main body together with air are filtered by a filter provided in the cleaner main body, to be collected, and the air is discharged outside.

According to a kind of vacuum cleaner, a collecting filter for collecting alien substances may be installed in the cleaner main body or separately installed at outside.

In such a vacuum cleaner, efficiency of sucking alien substances such as dust, crumbs, sand or the like on a floor together with air and noise generation are affected by a shape of a cleaner head. If a suction path formed between the cleaner head and a floor is big, a suction force for sucking alien substances such as dust is weakened compared to a suction. force generated in the cleaner main body, whereby alien substances are not effectively introduced thereinto. And, if the suction path between the cleaner head and a floor is small, a suction force becomes excessively strong whereby the cleaner head cannot move smoothly and noise is greatly generated.

In addition, a form of the cleaner head used when removing alien substance such as dust, crumbs, sand or the like in a carpet and a form of the cleaner head used when removing alien substances on a non-carpeted floor are difference from each other. Also, there is a cleaner head having one form that can be used in cleaning both carpet and non-carpeted floor.

FIGS. 1, 2 are perspective views showing one embodiment of a conventional cleaner head which is disclosed in U.S. Pat. No. 6,421,875. In the cleaner head, an air channel 12 having a certain width is formed at a bottom edge 11, which comes in contact with a floor, in a longitudinal direction, and a suction hole 13 through which air is sucked is positioned in the middle of the air channel 12. On the basis of the suction hole 12, the air channel on the left side becomes a left air channel, and that on the right. becomes a right air channel. A plurality of air channels 16 is respectively formed at certain intervals therebetween, within a front bottom edge 14 positioned in front of the air channel 12 and within a rear bottom edge 15 positioned in the rear of the air channel 12. Also, a brush 17 may be mounted to the rear bottom edge 15.

When a user cleans a floor, such a cleaner head moves along the floor with the bottom edge 11 contacted with the floor in a state that a suction force is applied to the suction hole 13. External air is sucked into a suction path formed by the air channels 12, 16 formed within the bottom edge 11 and the floor. At this time, the air is sucked to the air channels 16 formed within the front and rear bottom edges 14, 15, generating a vortex. The air is sucked into the suction path, together with alien substances or the like.

However, such a cleaner head is not proper for cleaning a carpet since the cleaner head sucks alien substances only with a suction force of air whereby alien substances such as dust, crumbs, sand or the like positioned between carpet fibers are not removed in cleaning the carpet.

FIG. 3 is a bottom view showing another embodiment of a conventional cleaner head which is disclosed in EP 0,552,652. In the cleaner head, a suction hole 21 having predetermined width and length is formed in a bottom of the head which comes in contact with a floor, and a front suction channel 21 and a rear suction channel 23 having certain width and length are formed in its bottom. The front suction channel 22 and the rear suction channel 23 are formed in a rectangular shape, and side passages 25, 26 are respectively formed at both walls of the two channels 22, 23.

The suction holes 21 are formed in the middle of the suction channel 22 and of the rear suction channel 23. A brush strip 26 is positioned between the first suction channel 22 and the rear suction channel 23. An end of the brush strip 26 is formed in a concavo-convex form, and its height is almost the same as a height of the bottom part of the head.

When a user cleans a floor or a carpet, such a cleaner head moves along a floor with a bottom of the head contacted with the floor in a state that a suction force is applied to the suction hole 21. External air is introduced thereinto through suction paths respectively formed by the front suction channel 22 of the cleaner head and a floor and by the rear suction channel 23 and the floor, and herein, the air is introduced, together with alien substances. At this time, the external air is introduced into the suction path through the side passages 24, 25, and the brush strip 26 scrapes carpet fibers.

However, in such a cleaner head, pressure is leaked between the front suction channel 22 and the rear suction channel 23 because of a brush strip 26 positioned between the front suction channel 22 and the rear suction channel 23 and having a concavo-convex form, thereby deteriorating intensity of flow. In addition, the brush cannot sufficiently scrapes carpet fibers to their root portions since the height of the brush-strip 26 is the same as that of the bottom part of the head, and air is sucked from the side, thereby cleaning cannot be sufficiently performed.

FIGS. 4, 5 are views showing still another embodiment of a conventional cleaner head, which is disclosed in EP 0,885,586. In the cleaner head, a suction channel is formed in a bottom edge 31 which comes in contact with a floor, and a suction hole 32 is positioned in the middle of the suction channel. A scraper blade 33 made of an elastic material and having certain width and area is mounted in front of the bottom edge 31, and a brush bar 34 is mounted in the rear of the scraper blade 33. When viewed based on the floor, an end of the scraper blade 33 is higher than the bottom edge, and an end of the brush bar 34 is higher than that of the scraper blade 33. A plurality of holes 35 is formed within the scraper blade 33 at certain intervals therebetween, and notches 36 corresponding to positions of the holes 35 are formed within the end portion of the brush bar 34.

When a user cleans a carpet or a non-carpeted floor, such a cleaner head moves along the floor with the bottom edge 31 contacted with the floor in a state that a suction force is applied to the suction hole 32. External air is sucked thereinto through a suction path formed by the suction channel and the floor, and herein, the air is sucked, together with alien substances. At this time, external air is sucked thereinto through both sides and a rear side of the bottom edge 31.

The scraper blade 33 and the brush bar 34 positioned in front of the bottom edge 31 push back carpet fibers.

However, in such a cleaner head, the scraper blade 33 and the brush bar 34 push back carpet fibers from outside the suction path, that is, in front of the bottom edge 31 and external air is sucked through a suction formed at both sides and a rear of the bottom edge 31, whereby alien substances cannot be effectively sucked from the roots of carpet fibers.

By the above mentioned conventional arts, when cleaning a non-carpeted floor, alien substances are sucked in a certain amount by a suction force applied to a suction path formed by an air channel and a floor, whereas when cleaning a carpet, alien substances cannot effectively sucked from roots of carpet fibers. Especially, if the carpet fiber is long, alien substances such as dust, crumbs, sand or the like are not sufficiently sucked from a root of the carpet fiber.

In addition, in the cleaner heads, a suction path through which alien substances are sucked is formed at both sides of the head when viewed in a direction that a cleaning proceeds, whereby alien substances are not effectively sucked.

DISCLOSURE OF THE INVENTION

Therefore, it is an object of the present invention to provide a cleaner head capable of effectively sucking alien substances from a non-carpeted floor and also, in cleaning a carpet, effectively sucking alien substances from a root of a carpet fiber.

It is another object of the present invention to provide a suction nozzle and a cleaner head having the same capable of improving suction performance of alien substances by forming a suction path through which air is sucked in a direction that a cleaning proceeds.

To achieve the above object, there is provided a suction nozzle including a suction hole to which a suction force is applied; an air channel formed as a closed region having certain area and depth and having the suction hole therein; and a scraper longer than an end of an edge of the air channel, positioned within the air channel, and for scraping carpet fibers in cleaning a carpet.

To achieve the above object, there is also provided a head of a vacuum cleaner including a housing having an inner path to which a suction force is applied; an inner air channel formed as a closed region having certain area and depth in a bottom of the housing which comes in contact with a floor and having a suction hole of the inner path therein; a scraper longer than an end of an edge of the inner air channel, positioned in the inner air channel, and for scraping carpet fibers in cleaning a carpet; a front blade and a rear blade movably inserted to the front and the rear of the inner air channel respectively, and forming an outer air channel in cleaning a floor; and a mode changing means mounted in the housing, and fixing the front blade and the rear blade by pushing or pulling them.

BRIEF DESCRIPTION OF THE DRAWINGS

FIGS. 1, 2 are perspective views showing one embodiment of a head of a conventional vacuum cleaner;

FIG. 3 is a bottom view showing another embodiment of a head of a conventional vacuum cleaner;

FIG. 4 is a side view showing still another embodiment of a head of a conventional vacuum cleaner;

FIG. 5 is a partial front view of the vacuum cleaner;

FIG. 6 is a bottom view showing one embodiment of a suction nozzle in accordance with the present invention;

FIG. 7 is a front view of a scraper constructing a suction nozzle in accordance with the present invention;

FIGS. 8, 9 are bottom views showing other embodiments of a suction nozzle in accordance with the present invention respectively;

FIG. 10 is a bottom view showing one embodiment of a head of a vacuum cleaner with a suction nozzle in accordance with the present invention;

FIGS. 11, 12 are side views respectively showing operational states of a suction nozzle in accordance with the present invention; and FIGS. 13, 14 are side views showing operational states of a vacuum cleaner head with a suction nozzle in accordance with the present invention.

MODES FOR CARRYING OUT THE PREFERRED EMBODIMENTS

Reference will now be made in detail to the preferred embodiments of the present invention, examples of which are illustrated in the accompanying drawings.

FIG. 6 is a bottom view showing one embodiment of a suction nozzle in accordance with the present invention.

As shown therein, a suction nozzle in accordance with the present invention includes: a suction hole 110 formed in a bottom of a housing 100 having a predetermined shape; an air channel 120 formed as a closed region having predetermined area and depth in the bottom of the housing 110, and having the suction hole 110 therein; and a scraper 140 longer than an end of an edge of the air channel, positioned in the air channel 120, and for scraping carpet fibers in cleaning the carpet.

An inner path (F) is formed in the housing, and a suction hole 110 for forming the inner path (F) is formed in the bottom of the housing 100. The inner path (F) of the housing 100 is connected to a cleaner main body whereby a suction force is applied thereto, and the bottom of the housing 100 puts on a floor in cleaning.

The air channel 120 is relatively short in its width and long in its length when viewed in a direction that a cleaning proceeds. Preferably, the air channel 120 is formed in a rectangular shape.

In addition, the air channel 120 is divided into a first region 121 having certain width and length and positioned in front, and a second region having certain width and length and positioned in rear. A scraper 140 is positioned in the first region, and a suction hole 110 is positioned within the second region 122. The first region 121 is formed in a rectangular shape and its bottom (on drawing) is a plane. The suction hole 110 is positioned in the middle of the second region 122, and a bottom (on drawing) of the second region 122 is formed inclined on the basis of the suction hole 110.

As shown in FIG. 7, the scraper 140 includes a quadrangular plate portion 141 having certain width and area; a plurality of notches 142 formed at an end portion of the plate portion 141; and a coupling portion 143 formed at the opposite side of the notches 142 and coupled to a bottom of the air channel 120. The scraper 140 may be made of a material having stiffness, or of a material having flexibility.

The scraper 140 is positioned in a direction perpendicular to the bottom of the first region 121, and the scraper 143 is fixedly coupled to the bottom of the first region 121. An end of the scraper 140, an end of a portion to which the notches 142 are positioned, is longer than a height of a bottom edge 130 forming the air channel 120. That is, when putting housing so that the air channel 120 puts on a floor, the end of the scraper 140 is longer than the bottom edge 130 forming the air channel 120.

The notches 142 are formed in a quadrangular shape one side of which is opened, at certain intervals therebetween. Preferably, notches 142 are positioned at both ends of the scraper 140 respectively.

As a modified form of the notches 142, the notches 142 may be formed at intervals which are not certain. In addition, the notches 142 may be formed in a triangular shape one side of which is opened.

As a modified form of the air channel 120, a first region having certain width and length is formed in front, and a second region having certain width and length is formed in rear. A suction hole 110 is positioned in the first region, and a scraper 140 is positioned in the second region. The suction hole 110 is positioned in the middle of the first region, and is formed inclined on the basis of the suction hole 110. A bottom (on drawing) of the second region is formed in a plane.

Reference numerals which have not been explained, 132, 133, 134, 135 are a front edge, a rear edge, a right edge and a left edge (on drawing) forming an edge of the air channel, respectively.

FIG. 8 is a view showing another embodiment of the suction nozzle in accordance with the present invention. The same parts as the above mentioned part will have the same numerals.

As shown therein, the suction nozzle includes a suction hole 110 formed in the bottom of a housing 110 having a predetermined shape; an air channel 120 formed as a closed region having predetermined area and depth, in the bottom of the housing 100, and having the suction hole 110 therein; and two scrapers 150 longer than an end of an edge 130 of the air channel 120, positioned in the air channel 120, and for scraping carpet fibers in cleaning a carpet.

The air channel 120 is divided into a first region 121 having certain width and length and positioned in front and a second region 122 having certain width and length and positioned in rear. Two scrapers 150, 160 are positioned in the first region, and a suction hole 110 is positioned within the second region 122. The first region 121 is formed in a quadrangular shape and its bottom (on drawing) is a plane. The suction hole 110 is positioned in the middle of the second region 122, and a bottom (on drawing) of the second region 122 is formed inclined on the basis of the suction hole 110.

The scrapers 150, 160 include: quadrangular plate portions 151, 161 having certain width and area; a plurality of notches 152, 162 formed at end portions of the plate portions 151, 161; and coupling portions 153, 163 formed at the opposite side of the notches 152, 162 and coupled to a bottom of the air channel 120.

The scrapers 150, 160 are positioned in a direction perpendicular to the bottom of the first region 121, and the coupling portions 153, 163 are fixedly coupled to the bottom of the first region 121, respectively. Preferably, the notches 152, 162 of the two scrapers 150, 160 are alternatively positioned. The scrapers 150, 160 may be integrally formed with the bottom of the first region 121.

The scrapers 150, 160 may be made of a material having stiffness, or of a material flexibility.

FIG. 9 is a sectional view showing still another embodiment of a suction nozzle in accordance with the present invention. The same parts as the above mentioned parts will have the same numerals.

As shown therein, the suction nozzle includes a suction hole 110 to which a suction force is applied; an air channel 120 formed as a closed region having predetermined area and depth, and having the suction hole 110 therein; a scraper 140 longer than an end of an edge 130 of the air channel 120, positioned in the air channel, and for scraping carpet fibers in cleaning a carpet; and side passages 131 through which air passes, and formed at both sides of the air channel 120 when viewed in a direction that the air channel 120 proceeds in cleaning.

In the suction nozzle, components except the side passages 131 are the same as explained above.

The side passages 131 having certain width and depth are formed at side edges forming side portions of the air channel 120. That is, the side passages 131 are formed at both sides of the air channel when viewed in a direction that a cleaning proceeds.

FIG. 10 is a view showing one embodiment of a cleaner head with a suction nozzle in accordance with the present invention. The same parts as the above mentioned parts will have the same numerals.

As shown in FIG. 10, a cleaner head with a suction nozzle in accordance with the present invention includes a housing 100 including an inner path (F) to which a suction force is applied; an inner air channel 120 formed as a closed region having predetermined area and depth in a bottom of the housing which comes in contact with a floor, and having a suction hole 110 of the inner path (F) therein; a scraper 140 longer than an end of an edge 130 of the inner air channel, positioned in the inner air channel 120 and for scraping carpet fibers in cleaning a carpet; a front blade 180 and a rear blade 190 movably inserted to the front and the rear of the inner air channel 120, respectively, and forming an outer air channel 170 in cleaning a floor; and a mode changing means (not shown) mounted in the housing 100, and for fixing the front blade 180 and the rear blade 190 by pushing or pulling them.

Wheels 101 having certain width and outer diameter are oppositely coupled to one side of the housing 100, and the inner path (F) of the housing 100 is connected to a cleaner main body by a separate connection hose.

The inner air channel 120, the scraper 140 and the suction hole compose a suction nozzle, and the structure of the suction nozzle is the same as described above.

The front blade 180 and the rear blade 190 have predetermined thickness and area, and a plurality of notches 181 is formed at an end of the front blade 180. Slots 102 having certain width and length are respectively formed in the bottom of the housing 100 at a certain interval therebetween, and the slots 102 are respectively positioned in front of a front edge and in rear of a rear edge which form the inner air channel 120. To the slots 102 are movably inserted the front blade 180 and the rear blade 190 respectively. The front blade 180 and the rear blade 190 are positioned in a direction perpendicular direction to the bottom of the housing.

The mode changing means is a known art which is generally used for a cleaner, and by controlling the mode changing means, the front blade 180 and the rear blade 190 are moved.

If the front blade 180 and the rear blade 190 are protruded from the bottom of the housing by controlling the mode changing means, ends of the front blade 180 and the rear blade 190 become higher than that of the scraper 140. And, when the front blade 180 and the rear blade 190 moves into the housing by controlling the mode changing means, ends of the front blade 180 and the rear blade 190 become lower than an edge 130 of the inner air channel 120 when viewed based on the bottom of the housing. At this time, the end of the scraper 140 is higher than the edge 130 of the inner air channel.

That is, in a state that the housing 100 is put on a carpet or a floor in order to clean the floor and the carpet, when the front blade 180 and the rear blade 190 are fixed protruded from the bottom of the housing 100 by controlling the mode changing means, the ends of the front blade 180 and the rear blade 190 come in contact with the carpet or the floor, thereby forming a path. Also, when the front blade 180 and the rear blade 190 are fixed inserted into the housing 100 by controlling the mode changing means, the end of the scraper 140 comes in contact with the carpet or the floor.

The front blade 180 and the rear blade 190 are made of a material having stiffness, or a material having flexibility, but, preferably, the front blade 180 is made of a material having stiffness and the rear blade 190 is made of a material having flexibility.

There may be two scrapers 140.

A reference numeral which has not been explained, 103 is a knob composing the mode changing means.

Hereinafter, operational effect of a suction nozzle and a cleaner head having the same in accordance with the present invention will now be described.

First, operations of the suction nozzle will now be described.

As a cleaner operates, a suction force is applied to a suction hole 110 of a suction nozzle. In a state that a suction nozzle is put on a carpet so that an air channel 120 of the suction nozzle puts on the carpet, a user moves the suction nozzle in forward and backward direction. At this time, as shown in FIG. 11, an end of the scraper 140 and the rear edge 133 of the air channel 120 come in contact with the carpet, and a suction path through which external air is introduced is formed by a gap between the carpet and the front edge 132 of the air channel 120 and the air channel 120. Especially, the notches 142 formed at the end of the scraper 140 form sufficient paths through which air is introduced, and, as controlling the sizes of the notches 142, flow resistance of air and suction force can be controlled.

External air is introduced through the suction path by a suction force applied to the suction hole 110, and herein, the air is sucked, together with alien substances such as dust in the carpet. In such a process, the scraper 140 positioned in the air channel 120 moves with the housing 110 to push back carpet fibers, thereby sucking air into the suction hole 110, together with alien substances such as dust positioned at roots of carpet fibers.

The scraper 140 is much longer than the front and rear edges 132, 133 forming the air channel 120, thereby sufficiently pushing back the carpet fibers, so that alien substances such as dust, crumbs, sand or the like which are positioned at the roots of the carpet fibers are efficiently sucked. In addition, the scraper 140 is positioned in the air channel 120, and also forms a suction path in a direction that a cleaning proceeds, so that alien substances on the carpet are sucked and removed effectively.

As shown in FIG. 12, if the scraper 140 is positioned in a direction perpendicular to the carpet, a suction path opened in every direction is formed between the carpet and an entire edge 130 forming the air channel 120 by the scraper 140.

External air is introduced in front, rear, left and right directions through the suction path by a suction force applied to the suction hole 110, and herein the air is sucked together with alien substances on the carpet. In such a process, the scraper 140 positioned in the air channel 120 moves with the suction nozzle, that is, housing, to push back carpet fibers, thereby sucking air into the suction hole 110, together with alien substances positioned at the roots of the fibers.

If there are two scrapes 140, the carpet fibers are pushed back more constantly, so that alien substances piled up at the roots of the carpet fibers are more effectively removed.

In case that side passages 131 are formed at left and right edges 134, 135 forming the air channel 120, when air suction resistance becomes excessive in a suction path formed between the carpet and the edge 130 of the air channel 120 by the scraper 140, the air suction resistance is controlled by enlarging the size of the suction path.

In addition, operations of a head of a cleaner with a suction nozzle in accordance with the present invention will now be described.

First, when cleaning a carpet, as shown in FIG. 13, the front blade 180 and the rear blade 190 are moved into the housing and are fixed by controlling a knob 103 of the mode changing means. When the front blade 180 and the rear blade 190 are positioned in the housing, a suction path is formed by a scraper 140 and an inner air channel 120, the carpet is cleaned with the same operations as explained above by such a structure. At this time, a suction force according to a direction of the suction path, air flow resistance, and the like is determined by locations and sizes of wheels mounted to the housing 100, a barycenter of the cleaner head, the scraper 140, an edge of the inner air channel and the like.

When cleaning a flat non-carpeted floor, as shown in FIG. 14, the front blade 180 and the rear blade 190 are fixed protruded from the bottom of the housing by controlling the knob 103 of the mode changing means, and by the protruded front blade 180, and rear blade 190 is formed an outer air channel 170. When the front blade 180 and the rear blade come in contact with the floor, a suction path through which external air is introduced is formed at the sides by the outer air channel 170 and the floor. When a suction force is applied to the suction hole 110, alien substances such as dust or the like plied up on the floor are sucked with air and are removed into the suction hole 110.

The cleaner head with a suction nozzle in accordance with the present invention can clean a carpet as well as a non-carpeted floor. Especially, when cleaning a carpet, the cleaner head with a suction nozzle in accordance with the present invention effectively removes alien substances such as dust or the like which are deeply piled up at carpet fibers.

As so far described, a suction nozzle and a head of a vacuum cleaner having the same, can effectively clean a non-carpeted floor, and also, in cleaning a carpet, sufficiently pushes back carpet fibers to their roots by a scraper to suck alien substances such as dust, crumbs, sand or the like. Accordingly, a carpet can be cleaned more cleanly, and also, a suction path through which external air is introduced is formed in a direction that a cleaning proceeds, that is, in a forward direction, to effectively introduce and remove alien substances, so that the carpet can be easily and speedily. cleaned.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A suction nozzle comprising:

a suction hole to which a suction force is applied;

an air channel formed as a closed region having predetermined area and depth, and having the suction hole therein; and a scraper longer than an end of an edge of the air channel, positioned in the air channel, and for scraping carpet fibers in cleaning the carpet, wherein the scraper includes air path therethrough.

2. The suction nozzle of claim 1, wherein the air channel is formed in a quadrangular shape which is short in its width and long in its length when viewed in a direction that a cleaning proceeds.

3. The suction nozzle of claim 1, wherein the air channel is divided into a first region having certain width and length and positioned in front and a second region having certain width and length and positioned in rear, the scraper is positioned in the first region, and the suction hole is positioned in the second region.

4. The suction nozzle of claim 3, wherein the suction hole is positioned in the first region, and the scraper is positioned in the second region.

5. The suction nozzle of claim 3, wherein the second region is formed inclined on the basis of the suction hole.

6. The suction nozzle of claim 3, wherein the first region is a plane.

7. The suction nozzle of claim 1, wherein the scraper comprises:

a quadrangular plate portion having certain thickness and area;

a plurality of notches formed at the end portion of the plate portion; and a coupling portion formed at the opposite side of the notches, and coupled to a bottom of the air channel.

8. The suction nozzle of claim 7, wherein the notches are formed at certain intervals therebetween.

9. The suction nozzle of claim 7, wherein the notches are formed at intervals which are not certain.

10. The suction nozzle of claim 7, wherein the notches are formed in a quadrangular shape.

11. The suction nozzle of claim 7, wherein the notches are formed in a triangular shape.

12. The suction nozzle of claim 7, wherein the notches are respectively positioned at both ends of the plate portion.

13. The suction nozzle of claim 1, wherein there are two scrapes, notches are respectively formed at both end portions of the two scrapes, and the notches formed at the two scrapers are alternatively formed.

14. The suction nozzle of claim 1, wherein the scraper is made of a material having flexibility.

15. A suction nozzle comprising:

a suction hole to which a suction force is applied;

an air channel formed as a closed region having predetermined area and depth, and having the suction hole therein;

a scraper longer than an end of an edge of the air channel, positioned in the air channel, and for scraping carpet fibers in cleaning a carpet; and side passages respectively formed at both side edges of the air channel and through which air passes, wherein the scraper includes air path therethrough.

16. A head of a vacuum cleaner comprising:

a housing having an inner path to which a suction force is applied;

an inner air channel formed as a closed region having predetermined area and depth in a bottom of the housing which comes in contact with a floor, and having a suction hole of the inner path therein;

a scraper longer than an end of an edge of the inner air channel, positioned in the inner air channel, and for scraping carpet fibers in cleaning a carpet;

a front blade and a rear blade movably inserted to the front and the rear of the air channel respectively, and forming an outer air channel in cleaning a floor; and a mode changing means mounted in the housing, and fixing the front blade and the rear blade by pushing or pulling them, wherein the scraper includes air path therethrough.

17. The head of claim 16, wherein the scraper comprises:

a quadrangular plate portion having a certain thickness and area;

a plurality of notches formed at an end portion of the plate portion; and a coupling portion formed at the opposite side of the notches and coupled to a bottom of the air channel.

18. The head of claim 16, wherein a plurality of notches is formed at an end of the front blade.

* * * * *